US010001116B2

(12) United States Patent
Yanase

(10) Patent No.: US 10,001,116 B2
(45) Date of Patent: Jun. 19, 2018

(54) SEALED COMPRESSOR AND REFRIGERATION DEVICE

(71) Applicant: Panasonic Intellectual Property Management Co., Ltd., Osaka (JP)

(72) Inventor: Seigo Yanase, Shiga (JP)

(73) Assignee: PANASONIC CORPORATION, Osaka (JP)

( * ) Notice: Subject to any disclaimer, the term of this patent is extended or adjusted under 35 U.S.C. 154(b) by 0 days. days.

(21) Appl. No.: 15/117,721

(22) PCT Filed: Apr. 22, 2015

(86) PCT No.: PCT/JP2015/002183
§ 371 (c)(1),
(2) Date: Aug. 9, 2016

(87) PCT Pub. No.: WO2015/170455
PCT Pub. Date: Nov. 12, 2015

(65) Prior Publication Data

US 2017/0009755 A1 Jan. 12, 2017

(30) Foreign Application Priority Data

May 7, 2014 (JP) ..... 2014-095634

(51) Int. Cl.
*F25B 1/00* (2006.01)
*F04B 35/04* (2006.01)
(Continued)

(52) U.S. Cl.
CPC ..... *F04B 35/04* (2013.01); *F04B 39/00* (2013.01); *F04B 39/0005* (2013.01);
(Continued)

(58) Field of Classification Search
CPC ..... F25B 39/04; F25B 31/00
(Continued)

(56) References Cited

U.S. PATENT DOCUMENTS 4,634,908 A 1/1987 Sturm
2007/0182261 A1 8/2007 Rapp et al.
(Continued)

FOREIGN PATENT DOCUMENTS

CN 102536731 A 7/2012
DE 102008000124 A1 7/2009
(Continued)

OTHER PUBLICATIONS

EP Search Report dated May 3, 2017 for the related EP Patent Application No. 15788770.4, 8 pages.
(Continued)

*Primary Examiner* — Melvin Jones
(74) *Attorney, Agent, or Firm* — Hamre, Schumann, Mueller & Larson, P.C.

(57) ABSTRACT

In a sealed compressor, electrically-operated element (104) and compressive element (106) driven by electrically-operated element (104) are housed in the inside of sealed container (102). Compressive element (106) includes shaft (126) formed of main shaft (136) and eccentric shaft (134), and cylinder block (128) having; bearing (144) which pivotally supports main shaft (136) of shaft (126); and cylinder (142). Further, the compressive element (106) includes piston (130) which is movable in the cylinder (142) in a reciprocating manner, and connecting portion (132) which connects eccentric shaft (134) and piston (130) to each other. Electrically-operated element (104) is formed of an outer-rotor-type motor which includes stator (150), and rotor (152) which is disposed coaxially with stator (150) so as to surround an outer periphery of stator (150). Further, non-sliding portion (146) is provided between main shaft (136) and bearing (144), and stator (150) is fixed to outer peripheral portion (162) of bearing (144) which corresponds to non-sliding portion (146).

6 Claims, 5 Drawing Sheets

(51) Int. Cl.

| | |
|---|---|
| ***F04B 39/00*** | (2006.01) |
| ***F04B 39/12*** | (2006.01) |
| ***F25D 11/00*** | (2006.01) |
| ***F25D 23/00*** | (2006.01) |
| ***F25B 31/02*** | (2006.01) |
| ***F04B 39/02*** | (2006.01) |
| *F25B 1/02* | (2006.01) |
| *F25D 17/06* | (2006.01) |

(52) U.S. Cl.
CPC ..... *F04B 39/023* (2013.01); *F04B 39/122* (2013.01); *F25B 31/023* (2013.01); *F25D 11/00* (2013.01); *F25D 23/006* (2013.01); *F25B 1/02* (2013.01); *F25D 17/062* (2013.01); *F25D 2317/0665* (2013.01); *F25D 2500/02* (2013.01)

(58) Field of Classification Search
USPC ..... 62/498, 508
See application file for complete search history.

(56) References Cited

U.S. PATENT DOCUMENTS

| | | | |
|---|---|---|---|
| 2008/0143198 | A1 | 6/2008 | Bi et al. |
| 2008/0290747 | A1 | 11/2008 | Nomura et al. |
| 2013/0078123 | A1 | 3/2013 | Fukasaku et al. |

FOREIGN PATENT DOCUMENTS

| | | | |
|---|---|---|---|
| DE | 102010051266 | | 5/2012 |
| DE | 102010051300 | | 5/2012 |
| DE | 102012217217 | A1 | 4/2013 |
| EP | 0 167 749 | A1 | 1/1986 |
| EP | 1 816 727 | A2 | 8/2007 |
| JP | 3007570 | U | 2/1995 |
| JP | 2005-344600 | | 12/2005 |
| JP | 2006-226273 | | 8/2006 |
| JP | 2008-289323 | | 11/2008 |

OTHER PUBLICATIONS

International Search Report of PCT application No. PCT/JP2015/002183 dated Aug. 4, 2015.

SEALED COMPRESSOR AND REFRIGERATION DEVICE

CROSS-REFERENCE TO RELATED APPLICATIONS

This application is a U.S. national stage application of the PCT International Application No. PCT/JP2015/002183 filed on Apr. 22, 2015, which claims the benefit of foreign priority of Japanese patent application 2014-095634 filed on May 7, 2014, the contents all of which are incorporated herein by reference.

TECHNICAL FIELD

The present invention relates to a sealed compressor and a refrigeration device such as a household-use electric freezer refrigerator or a showcase in which the sealed compressor is mounted.

BACKGROUND ART

Recently, along with diversification of food materials, a demand for the increase of a capacity of an indoor volume of a refrigeration device such as a household-use electric freezer refrigerator is increasing. To cope with such a demand, improvement has been made to increase capacity of a household-use electric refrigerator while maintaining a size of an external appearance of the household-use electric refrigerator. As one of methods for increasing the indoor volume, the reduction in size of a machine compartment which houses a sealed compressor has been in progress. In the sealed compressor used in the household-use electric freezer refrigerator, other refrigeration cycle devices and the like, the miniaturization and the reduction in height of the sealed compressor have been strongly required.

Under such a situation, among conventional sealed compressors, there has been known a sealed compressor which uses an outer-rotor-type DC motor in place of an inner-rotor-type DC motor (see Patent Literature 1, for example). The inner-rotor-type DC motor is configured such that a rotor rotates in the inside of a stator which forms an electrically-operated element. The outer-rotor-type DC motor where a rotor rotates outside a stator is provided for miniaturization and lowering of a height of the sealed compressor. Accordingly, the outer-rotor-type DC motor is suitable for miniaturization and the reduction of a thickness of the sealed compressor.

FIG. 5 is a side view showing a bearing mechanism and an electrically-operated element of a conventional sealed compressor.

As shown in FIG. 5, bearing mechanism 402 of the conventional sealed compressor includes: shaft 408 which includes main shaft 404 and eccentric shaft 406; and bearing 410 which pivotally supports main shaft 404. Sliding portions 412, 414 are formed on an outer periphery of main shaft 404 and an inner periphery of bearing 410, respectively.

Non-sliding portion 415 where an inner diameter is increased is formed on a portion of sliding portion 414 of bearing 410.

Electrically-operated element 418 is an outer-rotor-type DC motor formed of: stator 420; and rotor 422 disposed coaxially with stator 420. Rotor 422 is disposed so as to surround a periphery of stator 420.

Stator 420 is fixed to outer peripheral portion 423 of bearing 410 by press-fitting or the like. Sliding portion 414 is disposed on an inner periphery of bearing 410 at a position where stator 420 is fixed.

In rotor 422, permanent magnet 428 is disposed on outer peripheral end portion 426 of disc-like frame 424. Rotor 422 is fixed by shrinkage fitting or the like to an outer periphery of a lower end of shaft 408 at circular cylindrical rotor shaft hole 430 formed at a center of frame 424.

However, in the conventional sealed compressor, stator 420 is fixed to outer peripheral portion 423 of bearing 410 by press-fitting or the like. Accordingly, the conventional sealed compressor has a drawback that an inner peripheral surface of bearing 410 at the position where stator 420 is fixed is deformed and hence, solid contact occurs between the inner peripheral surface of bearing 410 and sliding portion 412 of main shaft 404 whereby the inner peripheral surface of bearing 410 is liable to wear.

CITATION LIST

Patent Literature

PTL 1: Unexamined German Patent Publication 102010051266 Specification

SUMMARY OF THE INVENTION

The present invention has been made to overcome such conventional drawbacks, and prevents the occurrence of wear by avoiding solid contact generated between a bearing and a main shaft even when an inner peripheral surface of the bearing at a fixed position is deformed at the time of fixing the stator to an outer peripheral portion of the bearing. Accordingly, it is an object of the present invention to provide a sealed compressor having high durability.

In a sealed compressor of the present invention, an electrically-operated element and a compressive element driven by the electrically-operated element are housed in a sealed container. The compressive element includes: a shaft having a main shaft and an eccentric shaft; a cylinder block including: a bearing which pivotally supports the main shaft of the shaft; and a cylinder; a piston which is movable in the cylinder in a reciprocating manner; and a connecting portion which connects the eccentric shaft and the piston to each other. The electrically-operated element is formed of an outer-rotor-type motor which includes: a stator; and a rotor which is disposed coaxially with the stator so as to surround an outer periphery of the stator. A non-sliding portion is provided between the main shaft and the bearing, and the stator is fixed to an outer peripheral portion of the bearing which corresponds to the non-sliding portion.

With such a configuration, even when an inner peripheral surface of the bearing at the position where the stator is fixed is deformed at the time of fixing the stator to the outer peripheral portion of the bearing, the non-sliding portion is provided between the main shaft and the bearing at the portion where the inner peripheral surface of the bearing is deformed. Accordingly, solid contact generated between the bearing and the main shaft can be avoided thus preventing the occurrence of wear.

The sealed compressor of the present invention can enhance durability of the sealed compressor.

DESCRIPTION OF EMBODIMENTS

Hereinafter, exemplary embodiments of the present invention are described with reference to drawings. The present invention is not limited by these exemplary embodiments.

First Exemplary Embodiment

Figure 1:
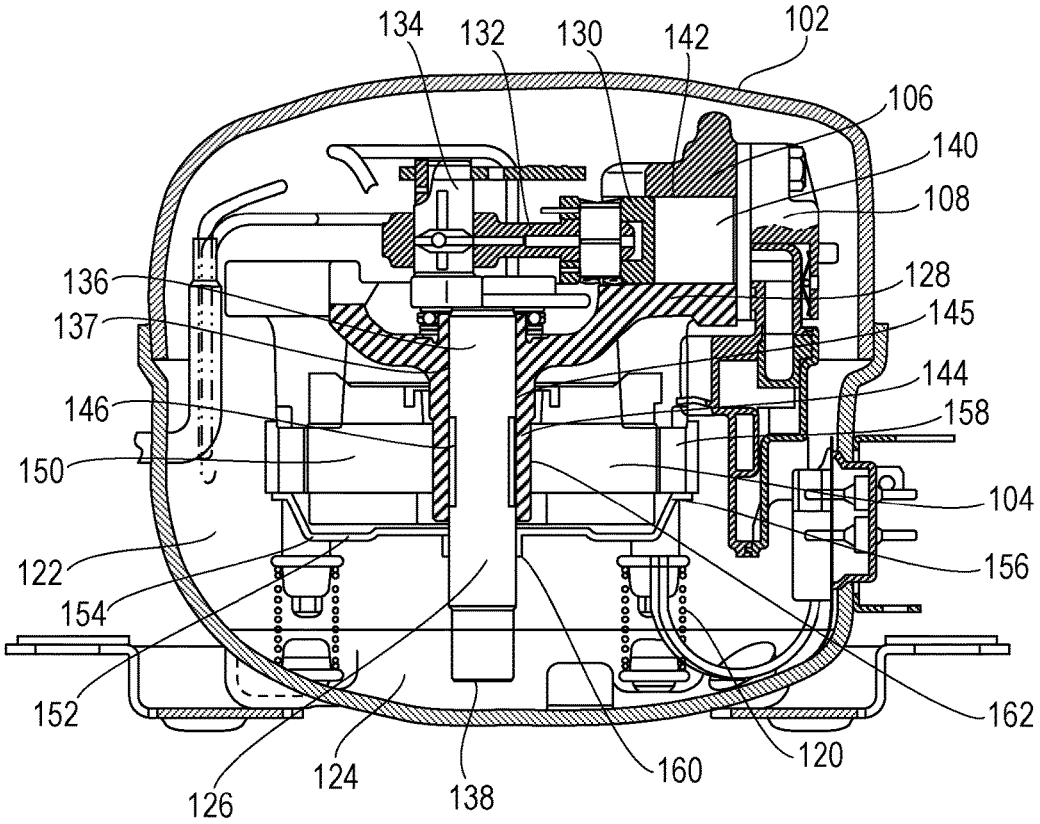
FIG. 1 is a cross-sectional view of a sealed compressor according to a first exemplary embodiment of the present invention.
Figure 2:
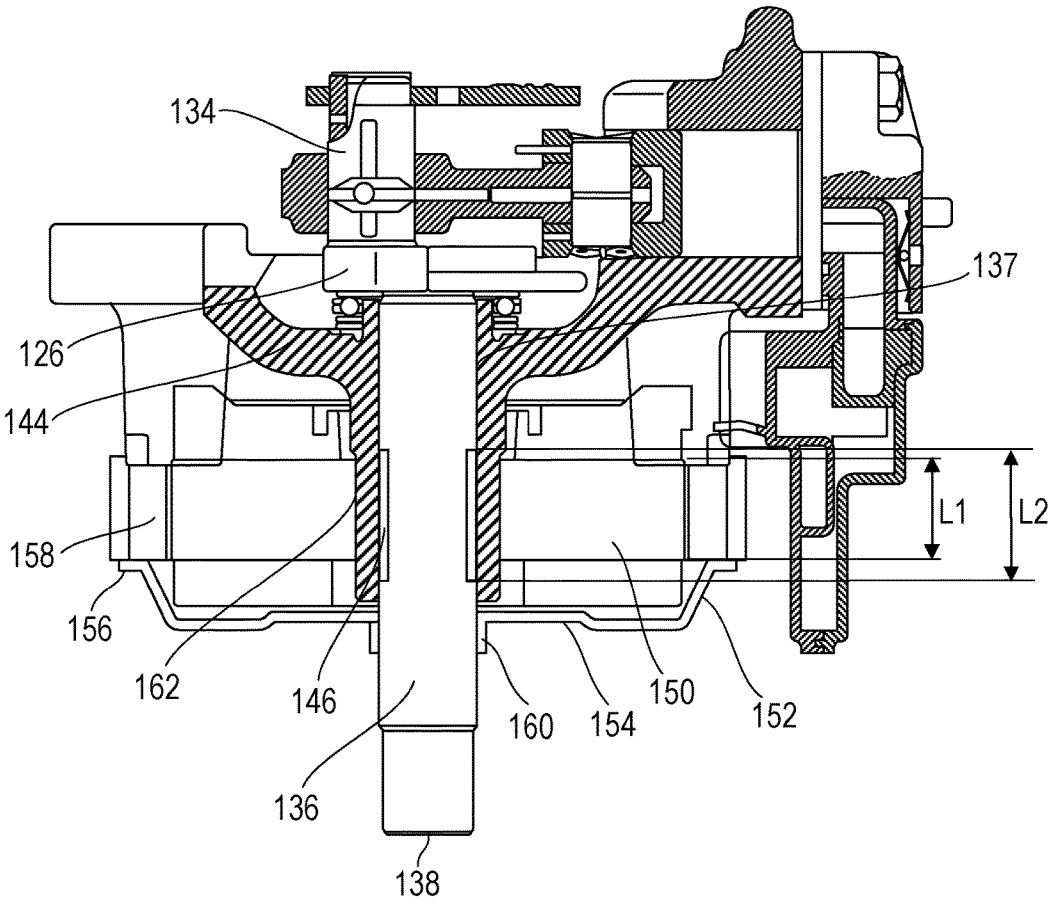
FIG. 2 is a cross-sectional view showing a main part of the sealed compressor according to the first exemplary embodiment of the present invention.

FIG. 1 is a cross-sectional view of a sealed compressor according to a first exemplary embodiment of the present invention. FIG. 2 is a cross-sectional view showing a main part of the sealed compressor.

In FIG. 1, the sealed compressor according to this exemplary embodiment is configured such that compressor body 108 which includes electrically-operated element 104 and compressive element 106 driven by electrically-operated element 104 is disposed in the inside of sealed container 102 formed by drawing a steel plate.

Compressor body 108 is resiliently supported by suspension springs 120.

Sealed container 102 is filled with refrigerant gas 122 which is at a pressure substantially equal to a pressure on a low-pressure side of a refrigeration device (not shown in the drawing) and in a relatively low temperature state. For example, refrigerant gas 122 is R600a which is a hydrocarbon refrigerant having a low global warming potential. A bottom portion in sealed container 102 is filled with lubrication oil 124.

Compressive element 106 is formed of: shaft 126; cylinder block 128; piston 130; connecting portion 132 and the like.

Shaft 126 includes: eccentric shaft 134; main shaft 136; and oil supply mechanism 138. Oil supply mechanism 138 is formed in a region ranging from a lower end of main shaft 136 which is immersed in oil 124 to an upper end of eccentric shaft 134.

Cylinder block 128 is an integral body formed of cylinder 142 which forms compression chamber 140 and bearing 144 which rotatably and pivotally supports main shaft 136.

Main shaft 136 has non-sliding portion 146 on a portion of sliding portion 137 which rotatably slides on an inner peripheral surface of bearing 144, where non-sliding portion 146 is formed by narrowing an outer diameter of main shaft 136. Non-sliding portion 146 is formed between an upper end and a lower end of bearing 144. More specifically, considering "a solid contact which occurs between the bearing and the main shaft" and "supply of oil", it is preferable that a size of non-sliding portion 146 in a radial direction formed on the portion of sliding portion 137 of main shaft 136 by narrowing an outer diameter of main shaft 136 be set between 0.2 mm and 1.0 mm (both inclusive). When the size in a radial direction of non-sliding portion 146 is less than 0.2 mm, it is impossible to avoid a solid contact between a deformed portion of the inner peripheral surface of bearing 144 which occurs when stator 150 is fixed to bearing 144 and main shaft 136. When the size in a radial direction of non-sliding portion 146 is larger than 1.0 mm, an oil supply speed at the time of starting the sealed compressor becomes slow so that oil cannot be sufficiently supplied in an upward direction.

Electrically-operated element 104 is an outer-rotor-type motor formed of; stator 150; and rotor 152 disposed coaxially with stator 150. Rotor 152 is disposed so as to surround a periphery of stator 150.

In rotor 152, permanent magnet 158 is disposed on outer peripheral end portion 156 of disc-like frame 154. In rotor 152, circular cylindrical rotor shaft hole 160 which is formed on a center of frame 154 is fixedly engaged with an outer periphery of the lower end of main shaft 136 by shrinkage fitting or the like.

Stator 150 is fixed to outer peripheral portion 162 of bearing 144 at a portion which corresponds to non-sliding portion 146 by press-fitting or the like.

Length L2 of non-sliding portion 146 formed on main shaft 136 is set longer than length L1 of fixing margin of stator 150. The fixing margin of stator 150 is positioned within length L2 of non-sliding portion 146.

The manner of operation and advantageous effects of the sealed compressor having the above-mentioned configuration is described hereinafter.

When electricity is supplied to electrically-operated element 104, an electric current flows through stator 150 so that a magnetic field is generated, and rotor 152 fixed to main shaft 136 rotates. Due to rotation of rotor 152, shaft 126 rotates. Then, piston 130 moves in a reciprocating manner in cylinder 142 by way of connecting portion 132 rotatably mounted on eccentric shaft 134, and compressive element 106 performs a predetermined compression operation.

Next, the manner of operation and advantageous effects acquired by providing non-sliding portion 146 between sliding portion 137 of main shaft 136 and bearing 144 are described.

Stator 150 of the outer-rotor-type DC motor according to this exemplary embodiment is fixed to outer peripheral portion 162 of bearing 144 by press-fitting or the like. Accordingly, the inner peripheral surface of bearing 144 is deformed in an inwardly recessed manner within a range of length L1 of the fixing margin of stator 150.

Then, solid contact occurs between the deformed portion of the inner peripheral surface of bearing 144 and main shaft 136.

However, non-sliding portion 146 which is formed by narrowing an outer diameter of main shaft 136 is provided to main shaft 136 of the sealed compressor according to this exemplary embodiment. Further, stator 150 is fixed to outer peripheral portion 162 of bearing 144 which is a portion which corresponds to non-sliding portion 146. Accordingly, it is possible to avoid solid contact between a deformed portion of the inner peripheral surface of bearing 144 which occurs when stator 150 is fixed to bearing 144 and main shaft 136 and hence, the occurrence of wear can be prevented. Accordingly, the durability of the sealed compressor can be enhanced.

Further, when stator 150 is fixed to outer peripheral portion 162 of bearing 144 by press-fitting or the like, bearing 144 is slightly deformed also outside fixing margin of stator 150.

However, in this exemplary embodiment, length L2 of non-sliding portion 146 is set longer than length L1 of the fixing margin where stator 150 is fixed to outer peripheral portion 162 of bearing 144. Accordingly, also with respect to the deformation which occurs on bearing 144 outside the fixing margin of stator 150, solid contact between main shaft 136 and bearing 144 can be avoided.

From results of analysis and experiment, it is confirmed that the inner peripheral surface of bearing 144 is deformed to a position disposed 1 mm outside the fixing margin of stator 150. Accordingly, by setting length L2 of the non-sliding portion longer than length L1 of the fixing margin by 2 mm or more, it is possible to avoid even slight solid contact between sliding portion 137 of main shaft 136 and bearing 144. Therefore, the durability of the sealed compressor can be further enhanced.

Non-sliding portion 146 is formed by narrowing the outer periphery thereof on a main shaft 136 side and hence, non-sliding portion 146 can be easily formed by lathe machining or the like. Further, deburring or the like after polishing an outer periphery of the main shaft can be also easily performed and hence, the productivity of the sealed compressor can be enhanced.

As has been described heretofore, in the sealed compressor of this exemplary embodiment, electrically-operated element 104 and compressive element 106 which is driven by electrically-operated element 104 are housed in the inside of sealed container 102. Compressive element 106 includes: shaft 126 having main shaft 136 and eccentric shaft 134; and cylinder block 128 having: bearing 144 which pivotally supports main shaft 136 of shaft 126; and cylinder 142. Compressive element 106 includes: piston 130 which is movable in cylinder 142 in a reciprocating manner, and connecting portion 132 which connects eccentric shaft 134 and piston 130 to each other. Electrically-operated element 104 is formed of an outer-rotor-type motor which includes: stator 150; and rotor 152 which is disposed coaxially with stator 150 so as to surround the outer periphery of stator 150. Non-sliding portion 146 is disposed between main shaft 136 and bearing 144, and stator 150 is fixed to outer peripheral portion 162 of bearing 144 which corresponds to non-sliding portion 146.

With such a configuration, in fixing stator 150 to outer peripheral portion 162 of bearing 144, even when the inner peripheral surface of bearing 144 at the position where stator 150 is fixed is deformed, non-sliding portion 146 is provided between main shaft 136 and bearing 144 at the deformed portion. Accordingly, a solid contact which occurs between bearing 144 and main shaft 136 is avoided so that the occurrence of wear can be prevented. Accordingly, the durability of the sealed compressor can be enhanced.

Further, the length of non-sliding portion 146 is longer than the length of the fixing margin where stator 150 is fixed to outer peripheral portion 162 of bearing 144. With such a configuration, in fixing stator 150 to outer peripheral portion 162 of bearing 144, even when a portion of the inner peripheral surface of bearing 144 disposed outside the fixing margin where stator 150 is fixed is deformed, the length of non-sliding portion 146 is set longer than the length of the fixing margin of stator 150. Hence, a solid contact which occurs between bearing 144 and main shaft 136 is avoided so that the occurrence of wear can be prevented. Accordingly, the durability of the sealed compressor can be further enhanced.

Still further, non-sliding portion 146 which is formed by narrowing an outer diameter of main shaft 136 is formed on a portion of sliding portion 137 of main shaft 136 and, further, non-sliding portion 146 is formed between the upper end and the lower end of bearing 144. With such a configuration, an outer periphery of main shaft 136 can be easily narrowed by lathe machining or the like, and deburring or the like after polishing the outer periphery of main shaft 136 can be also easily performed. Accordingly, the productivity of the sealed compressor can be enhanced.

Second Exemplary Embodiment

Figure 3:
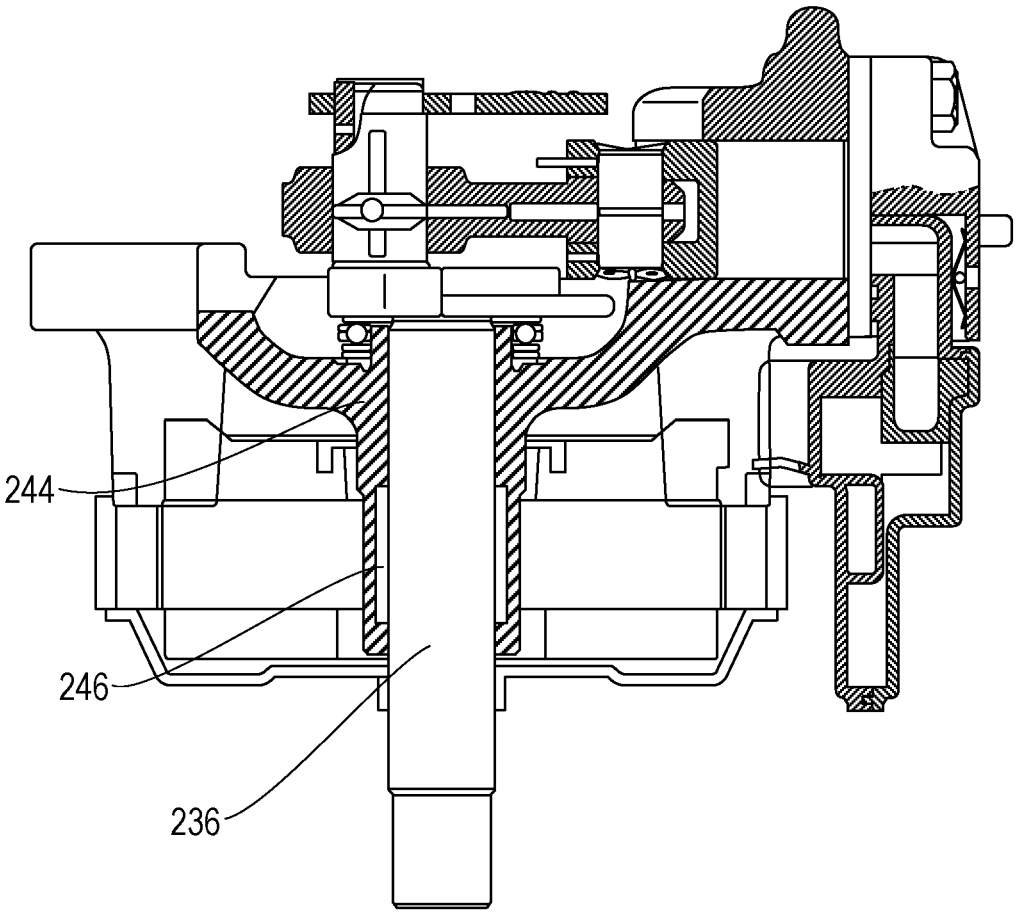
FIG. 3 is a cross-sectional view showing a main part of a sealed compressor according to a second exemplary embodiment of the present invention.

FIG. 3 is a cross-sectional view showing a main part of a sealed compressor according to a second exemplary embodiment of the present invention. In this exemplary embodiment, parts identical with the parts of the first exemplary embodiment are given the same symbols and the description of those parts is omitted.

In the case of this exemplary embodiment, non-sliding portion 246 is formed on a bearing 244 side. That is, non-sliding portion 246 formed by increasing an inner diameter of bearing 244 is formed on a portion of a sliding portion of bearing 244. More specifically, considering "a solid contact which occurs between the bearing and the main shaft" and "supply of oil", it is preferable that a size of non-sliding portion 246 in a radial direction which is formed on the portion of the sliding portion of bearing 244 by increasing an inner diameter of bearing 244 be preferably set between 0.2 mm and 1.0 mm (both inclusive). When the size in a radial direction of non-sliding portion 246 is less than 0.2 mm, it is impossible to avoid a solid contact between a deformed portion of the inner peripheral surface of bearing 244 which occurs when the stator is fixed to bearing 244 and main shaft 236. When the size in a radial direction of non-sliding portion 246 is larger than 1.0 mm, an oil supply speed at the time of starting the sealed compressor becomes slow so that oil cannot be sufficiently supplied in an upward direction. With the above-mentioned configuration of this exemplary embodiment, even when a sliding area is decreased so that a slide loss is reduced by narrowing an outer shape of main shaft 136, the lowering of rigidity of main shaft 236 can be prevented. Accordingly, the efficiency of the operation of the sealed compressor can be enhanced and, at the same time, the durability of the sealed compressor can be enhanced. Further, the advantageous effects substantially equal to the advantageous effects of the first exemplary embodiment can be acquired.

In the first and second exemplary embodiments, the description has been made with respect to the case where stator 150 is fixed to outer peripheral portion 162 of bearing 144 by press-fitting or the like. However, also when stator 150 is fixed by welding, the inner peripheral surface of bearing 144 is deformed by thermal distortion and hence, substantially the same advantageous effects can be acquired.

As has been described heretofore, the sealed compressor of this exemplary embodiment includes non-sliding portion 246 which is formed by increasing an inner diameter of bearing 244 on a portion of the sliding portion of bearing 244. With such a configuration, even when an outer diameter of main shaft 236 is narrowed for reducing a sliding loss, the lowering of rigidity of main shaft 236 can be prevented. Accordingly, the efficiency of the operation of the sealed compressor can be enhanced. Further, the durability of the sealed compressor can be enhanced.

Third Exemplary Embodiment

Figure 4:
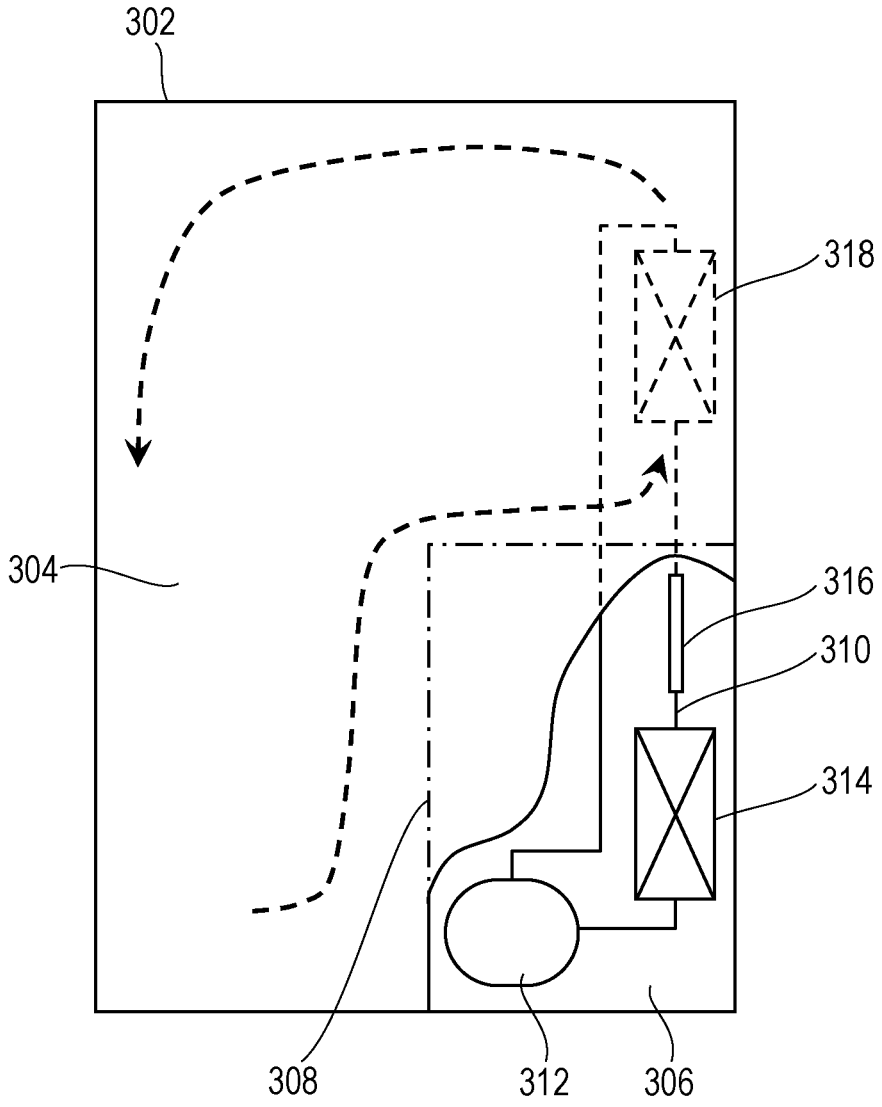
FIG. 4 is a schematic view of a refrigeration device according to a third exemplary embodiment of the present invention.
Figure 5:
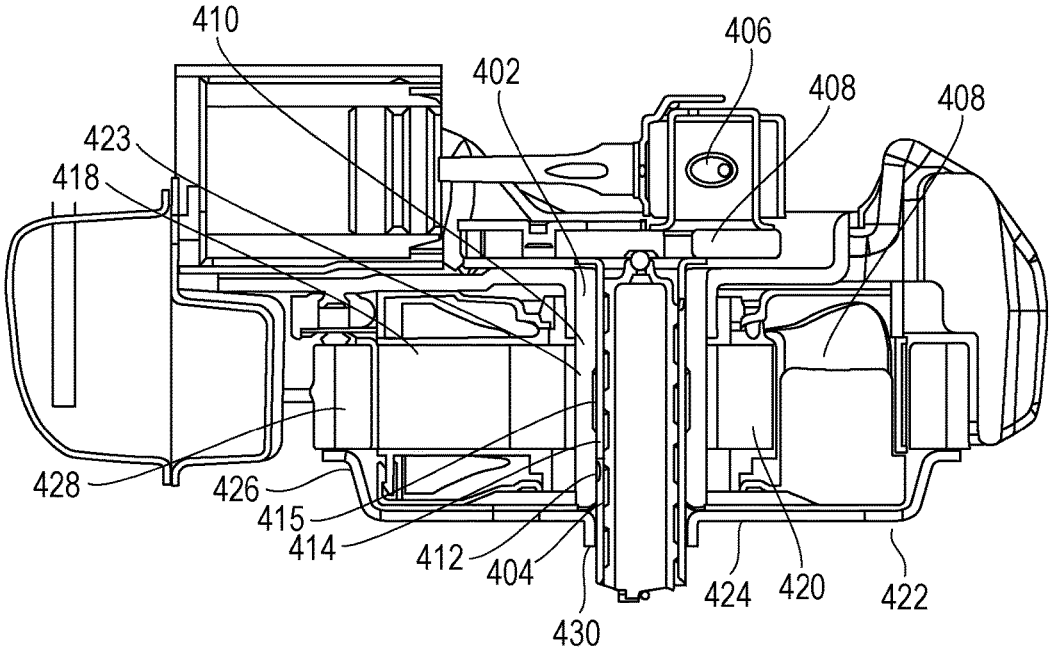
FIG. 5 is a side view showing a bearing mechanism and an electrically-operated element of a conventional sealed compressor.

FIG. 4 is a schematic view showing a refrigeration device according to a third exemplary embodiment of the present invention. The sealed compressor described in the first or second exemplary embodiment is mounted in the refrigeration device. In this exemplary embodiment, the refrigeration device is schematically described by taking an article storage device such as a refrigerator as an example.

In FIG. 4, the article storage device includes body 302 which is formed of a heat insulating box having an opening on one surface thereof and a door body which opens and closes the opening; partition wall 308; and refrigerant circuit 310. Partition wall 308 partitions the inside of body 302 into article storage space 304 and machine compartment 306. Refrigerant circuit 310 cools storage space 304.

Refrigerant circuit 310 is configured such that the sealed compressor described in the first exemplary embodiment which forms compressor 312, heat-radiator 314, pressure reduction device 316, and heat absorbing device 318 are annularly connected to each other by pipes. Heat absorbing device 318 is disposed in the inside of storage space 304 equipped with a blower (not shown). Cooling heat of heat absorbing device 318 is stirred by the blower so that cooling heat circulates the inside of storage space 304 as indicated by an arrow. With such an operation, storage space 304 is cooled.

In the article storage device which has been described heretofore, the sealed compressor described in the first exemplary embodiment is mounted as compressor 312. Accordingly, in compressor 312, stator 150 is fixed to outer peripheral portion 162 of bearing 144 which corresponds to non-sliding portion 146 provided between main shaft 136 and bearing 144 by press-fitting or the like. With such a configuration, even when the inner periphery of bearing 144 is deformed by fixing stator 150, the occurrence of wear which may be caused by a solid contact between the deformed portion of bearing 144 and main shaft 136 can be prevented. Accordingly, the durability of compressor 312 can be enhanced. As a result, the durability of the article storage device can be enhanced.

As has been described heretofore, the refrigeration device of this exemplary embodiment includes refrigerant circuit 310 which is formed by annularly connecting compressor 312, heat-radiator 314, pressure reduction device 316, and heat absorbing device 318 to each other by pipes, and compressor 312 is the sealed compressor described in the first or second exemplary embodiment. Accordingly, by mounting the sealed compressor whose durability is enhanced in the refrigeration device, the durability of the refrigeration device can be enhanced.

INDUSTRIAL APPLICABILITY

As has been described heretofore, the sealed compressor and the refrigeration device according to the present invention can enhance the durability of the sealed compressor. Accordingly, the present invention is not limited to household-use electric appliances such as an electric refrigerator or an air conditioner, and is broadly applicable to a refrigeration device for a business-use showcase, a vending machine and the like.

The invention claimed is:

1. A sealed compressor, wherein an electrically-operated element and a compressive element driven by the electrically-operated element are housed in a sealed container, the compressive element includes:

a shaft having a main shaft and an eccentric shaft;

a cylinder block including: a bearing which pivotally supports the main shaft of the shaft; and a cylinder;

a piston which is movable in the cylinder in a reciprocating manner; and a connecting portion which connects the eccentric shaft and the piston to each other, the electrically-operated element is formed of an outer-rotor-type motor which includes: a stator; and a rotor which is disposed coaxially with the stator so as to surround an outer periphery of the stator, a sliding portion is provided between the main shaft and the bearing, a non-sliding portion is provided between the main shaft and the bearing, and the stator is fixed to an outer peripheral portion of the bearing which corresponds to the non-sliding portion, wherein a length of the non-sliding portion is set larger than a fixing margin where the stator is fixed to the outer peripheral portion of the bearing.

2. The sealed compressor according to claim 1, wherein the non-sliding portion is formed between an upper end and a lower end of the sliding portion.

3. The sealed compressor according to claim 2, wherein the non-sliding portion is provided on a portion of the sliding portion, and the non-sliding portion is formed by narrowing an outer diameter of the main shaft.

4. A refrigeration device comprising a refrigerant circuit formed by annularly connecting a compressor, a heat-radiator, a pressure reduction device and a heat absorbing device to each other by pipes, wherein the compressor is the sealed compressor according to claim 1.

5. A sealed compressor, comprising:

a shaft having a main shaft and an eccentric shaft;

a bearing which pivotally supports the main shaft of the shaft;

a cylinder;

a piston which is movable in the cylinder in a reciprocating manner;

a connecting portion which connects the eccentric shaft and the piston to each other, a non-sliding portion which is provided between the main shaft and the bearing; and an outer-rotor-type motor including:

a stator which is fixed to an outer peripheral portion of the bearing which corresponds to the non-sliding portion; and a rotor which is disposed coaxially with the stator so as to surround an outer periphery of the stator, wherein a length of the non-sliding portion is set larger than a fixing margin where the stator is fixed to the outer peripheral portion of the bearing.

6. The sealed compressor according to claim 2, wherein the non-sliding portion formed by increasing an inner diameter of the bearing is formed on a portion of the sliding portion.

* * * * *